US005253960A

United States Patent [19]

Scott

[11] Patent Number: 5,253,960

[45] Date of Patent: Oct. 19, 1993

[54] CABLE ATTACHABLE DEVICE TO MONITOR ROOF LOADS OR PROVIDE A YIELDABLE SUPPORT OR A RIGID ROOF SUPPORT FIXTURE

[76] Inventor: James J. Scott, HCR 33, Box 36, Rolla, Mo. 65401

[21] Appl. No.: 926,996

[22] Filed: Aug. 10, 1992

[51] Int. Cl.[5] ..... E21D 21/00

[52] U.S. Cl. ..... 405/302.2; 405/259.1; 405/288; 411/8

[58] Field of Search ..... 405/259.1-259.6; 411/55, 8, 63-65, 70, 71, 15

[56] References Cited

U.S. PATENT DOCUMENTS 3,478,523 11/1969 Reusser et al. .

4,369,003 1/1983 Brandstetter ..... 405/259.4 X

*Primary Examiner*—Dennis L. Taylor

*Attorney, Agent, or Firm*—Polster, Lieder, Woodruff & Lucchesi

[57] ABSTRACT

A cable attachment assembly having an anchor mechanism for gripping a tension member anchored in a bore hole in a mine roof, and a roof plate mounted on the anchor mechanism in positions for observing the support being offered to the mine roof, or the yielding response of the roof plate on the anchor mechanism, or for monitoring the load-yield relationship of the anchor mechanism relative to the tension member.

10 Claims, 2 Drawing Sheets

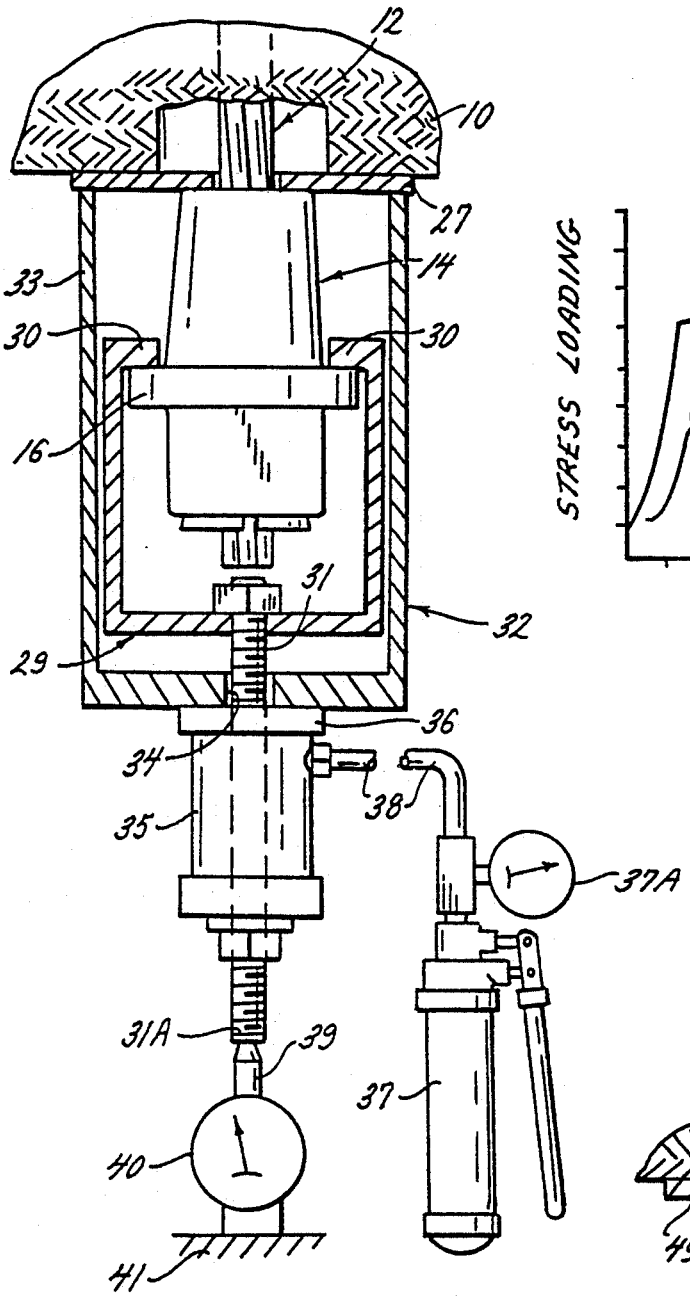
FIG. 5.
FIG. 6.
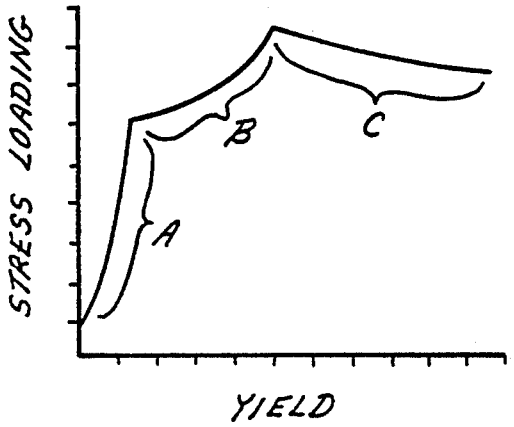
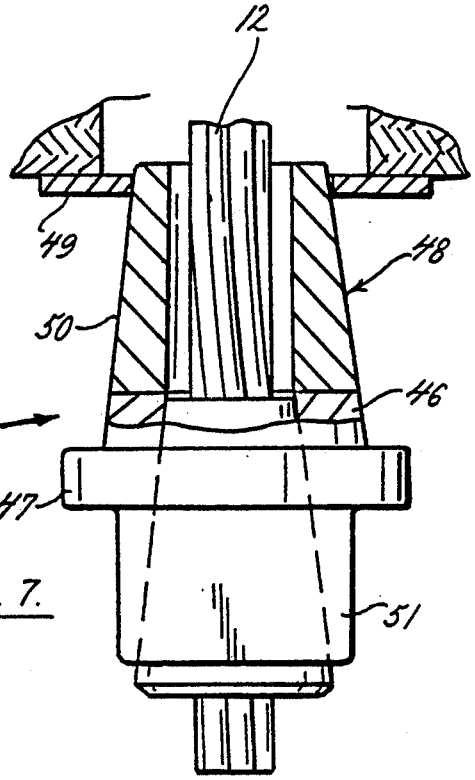
FIG. 7.

CABLE ATTACHABLE DEVICE TO MONITOR ROOF LOADS OR PROVIDE A YIELDABLE SUPPORT OR A RIGID ROOF SUPPORT FIXTURE

BACKGROUND OF THE INVENTION

1. Field of the Invention

The invention is directed to a mine roof support fixture to develop an effective load control monitor to respond to movement of the roof material or respond as a rigid support or a yieldable support.

2. Description of the Prior Art

It is known that in the creation of underground passages geologic forces are released which cause strains in the earth surrounding the passage, and that the strain is reflected by movements of the geologic material, especially in the roof of such passage. Means for resisting the forces to re-establish balance are such that they retard movement of the geologic material, not only in the roof, but around the passage and such means can be in several different forms. An early form of roof bolt is disclosed in Ralson U.S. Pat. No. 2,850,937 on Sep. 9, 1958. In this disclosure, the roof bolt imbodies indicated means which can be seen and which convey information regarding whether or not the roof bolt is supporting its desired load in the mine roof.

References also made to Emery U.S. Pat. No. 3,226,934 of Jan. 4, 1966, Reusser U.S. Pat. No. 3,478,523 of Nov. 18, 1969, directed to rock bolts having a load bearing plate for use in mine roof support. Many other patents exist on roof bolt fixtures and on cable anchored fixtures which include Scott U.S. Pat. No. 4,378,180 of Mar. 29, 1983. The prior art also includes Askey et al U.S. Pat. No. 3,797,254 of Mar. 19, 1974.

In certain roof support fixtures the design is directed to overcoming the problems of placing long bolts in low seam heights which requires coupling of the parts of the fixture and a weakening of the fixture due to the couplings. The couplings also increase the cost and the thread of the rod produce stress concentrations Holes into which these type roof fixtures are placed are larger to accomodate the oversized couplings. A cable-type roof bolt, for example a 7-strand cable, ⅜ inch diameter or ½ inch diameter, can readily be placed in a one inch diameter hole in a low seam by bending the cable in order to obtain insertion, thus eliminating couplings. A difficulty with this cable support is it is hard to make an attachment to the end which will allow rotation of the cable upon insertion and for retaining the roof plate.

SUMMARY OF THE INVENTION

It is therefore one of the principle objects of the invention to provide a rigid attachment fixed to the end of a cable in the form of a wedge-like grip unit which has special features in its design which provide a seat for hardened steel wedges which in turn grip the cable to assure that it will not move or slip on the cable other than enough movement to fully seat wedges.

It is a further object of the invention to provide a special outer surface to the attachment unit which provides a heavy ring upon which a mine roof plate can bear to carry loads immediately upon installation, and when a roof plate is placed against the ring, the cable will accept load quickly if the rock deforms.

Another object is to provide an anchor mechanism for the cable in the hole which will provide a way of visually observing the support that the plate is giving to the geologic material by the periodic observation of the spacial distance between an anchor plate on the conic surface of the anchor mechanism and the rigid flange on that mechanism.

A further object of the invention is to adjust the roof plate thickness so that plate movement of the roof plate relative to the tapered fixture will be at a desired design yield.

It is a further object of the present invention to provide a rigid anchor for a plate held against the roof surface means to provide an arrangement of an exposed cable roof support anchor device for monitoring the load-yield relationship.

These and other objects of the invention will be set forth in the details of the construction as seen in the several views of the drawing.

BRIEF DESCRIPTION OF THE DRAWINGS

The preferred embodiment of the improvement is illustrated in which:

FIG. 5 is a view like FIG. 2 when arranged for monitoring the rigid device for cable load measurement; and FIG. 6 is a chart illustrating a load-yield relationship; and FIG. 7 is a view of a modified device in which a separate cone extension is seated on a modified anchor body to improve the roof support system.

DETAIL DESCRIPTION OF THE EMBODIMENT

Figure 1:
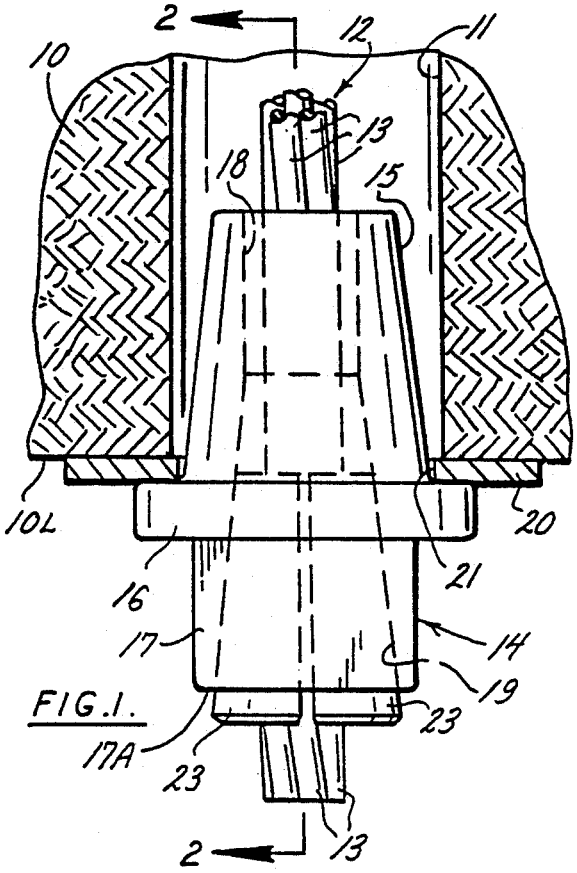
FIG. 1 is a fragmentary schematic view of the anchor device forming a primary support for the geologic structure surrounding the entrance at a mine roof borehole.
Figure 2:
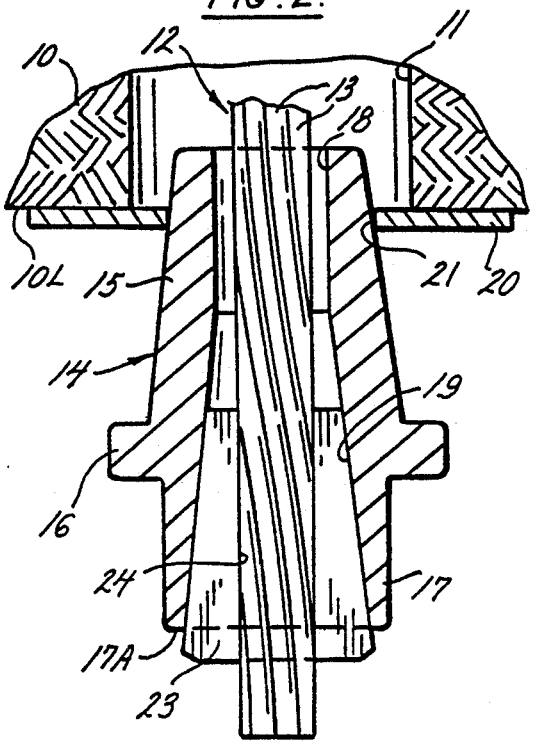
FIG. 2 is a longitudinal sectional view along line 2—2 of FIG. 1, but modified with the device carrying a roof plate on the conic surface thereof in a position to yield as load increases.
Figure 3:
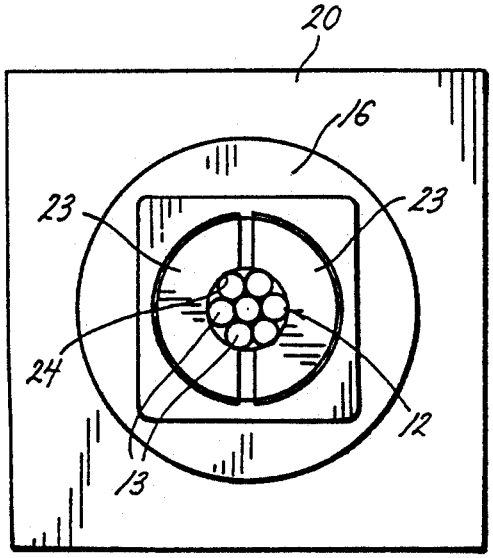
FIG. 3 is a view of the device of FIG. 1 as seen looking upwardly from below the view of FIG. 1.

In FIGS. 1 and 2 the geologic roof material is seen at 10 in which at least the entry portion of a suitable borehole 11 has been formed up to a desired predetermined depth to receive an anchor of any desired character to hold the inner (or upper) end of a tension cable 12 in the borehole 11. The anchorage can be of the quick setting adhesive which is currently employed, such as is shown in Hipkins, Jr., et al U.S. Pat. No. 4,477,209 of Oct. 16, 1984 or Rozanc U.S. Pat. No. 4,564,315 of Jan. 14, 1986, both of which are incorporated herein for that purpose. That cable 12 may include several strands of wires 13 which together constitute the cable 12. The outer or exposed end of the cable 12 is received in an anchor body 14 having an elongated tapering or cone shaped extension 15 rising above a rigid flange 16, while an opposite extension is provided in the form of a tool engaging hexagonal or square nut 17 formed integrally below the flange 16. The cone shape body extension 15 is formed to provide a sloping surface of any desired angular degree, although about a 7° slope from the vertical is practicle. The body 14, on the other hand, has a bore 18 of uniform cylindrical configuration extending downwardly or inwardly through the cone extension 15, and thereafter the body 14 is formed with an outwardly tapering bore 19, which continues through the nut formation 17 to outer open end 17A.

Figure 4:
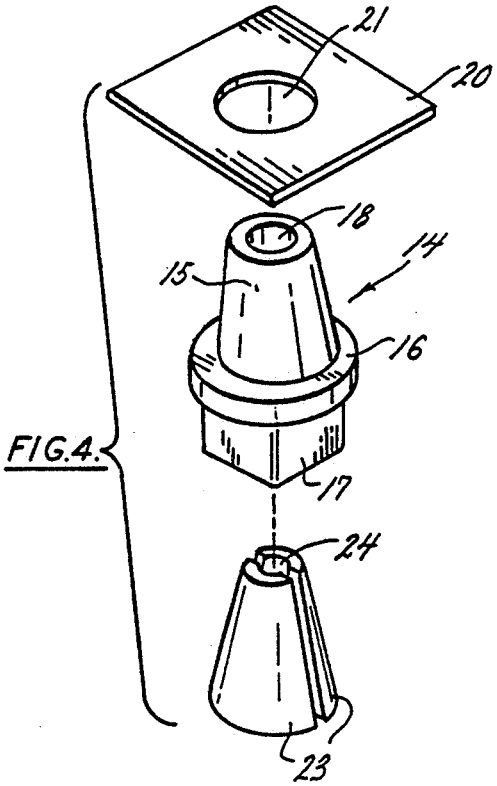
FIG. 4 is an exploded view of a typical device with the parts in axial spaced alignment of the elements of the device.

Continuing on, the body 14 is adapted to receive a rectangular roof plate 20 that slides over the cone extension 15 before the cable 12 is received in the body 14 by properly sizing the internal diameter of the bore 18 and 19. In addition, there are a pair of wedge shaped securing elements 23 formed with an enternal groove 24 (FIG. 4) to form between them a substantially cylindrical passage to receive the strands 13 of the cable 12. The outer surfaces of the wedges 23 are tapered so that they together can be received in the tapered bore 19 of the body 14. As these tapering wedge elements 23 move upwardly in the tapered bore 19 they are forced radially inwardly so the internal grooves 24 close upon the cable 12, or a rod if the cable is not employed.

In comparing FIG. 2 with FIG. 1, it is observed that the body 14 of FIG. 2 is more fully exposed below the position of a roof plate 20 relative to the roof line 10L of the geologic structure. That exposure is evident by the spacing between the roof plate 20 and the flange 16 on the body 14. This provides a visual measure of the extent of movement of the mine passage roof line 10L. The view of FIG. 1 illustrates the position of the mine roof relative to the fixed position of the body 14 on the cable 12. However, in FIG. 2 any reduction in the spacing between the plate 20 and the flange 16 is the result of movement of the roof since the cable 12 is anchored in the back of the borehole 11. After that spacing between plate 20 and flange 16 has been reduced to zero, further movement of the combined plate and body 14 is the result of yield in the cable 12, or perhaps slippage of the upper end of the cable in the borehole 11.

For example, an appropriate thickness of roof plate 20 and diameter of hole 11, a roof plate can be placed on the tapered upper portion 15 of the attachment body 14. Upon installation, the plate 20 can be spaced several inches above the heavy retaining ring 16. During the subsequent movement of the geological material 10, the plate 20 will be loaded to cause deformation of the plate and force it to slide down the incline surface 15. The level of load at which the plate 20 slides on the taper 15 can be adjusted by changing the thickness of the plate 20. For example, a ¼ inch thick plate may yield near 7 tons; and a ⅜ inch thick plate, near 12 tons. If other thicknesses of the plates are tested appropriate results can be determined. Yield will take place until the plate 20 slides onto the flange 16 on the attachment body 14. At that point the roof support becomes stiff and any further yield will be due to stretch in the cable 12. The development of that condition is illustrated by the portion A in the graph in FIG. 6 where the yielding displacement of the roof plate 20 is not very great while the load imposed thereon increases rapidly. The portion B of the load-yield graph depicts the yielding of the plate 20 on the tapered surface 15, and to some extent the elongation taking place in the cable 12. The portion C of the load-yield graph illustrates the condition of a constant yield in the plate 20 in relation to a constant geologic rock load.

A modification in the present installation of the anchor body 14 is seen in FIG. 5 which provides means whereby the loads carried by cable supports 12 can be monitored. This can be done by placing a plate 27 over the cable 12 so it seats against the uppermost end 28 of the attachment body 14 with a small hole in it approximately equal to the diameter of the cable 12, say ¾ inch diameter. The plate 27 then will bear against the roof line 10L and will accept loads in the manner of a semi-rigid fixture. As the geologic structure loads build up on the plate 27, the cable 12 will be stressed and to some extent it will be stretched. If at any time the mine operator desires to measure the load upon the cable, the operator may use a well known crows foot measuring device 29 seen in FIG. 5. That device 29 is in the form of a frame that has foot elements 30 engaged on the flange 16 of the body 14. That frame 29 carries a pull bolt 31 located in the axis of the cable 12. A bell jar 32 is placed over the crows foot frame 29, as shown, so that the end of wall 33 thereof engage against the plate 27 and use that plate as a surface against which the frame 32 pushes. The frame 32 is formed with an aperture 34 to allow the pull bolt 31 to extend through and pass through a hydraulic cylinder 35. The cylinder 35 engages the bell jar 32 by a flange 36, and the interior of the cylinder 35 has a piston (not shown) that adjustably engages the pull bolt 31 so that the bell jar 32 and crows foot 29 are properly in position. Actuation of the pump 37 will supply fluid through the hose 38 and into the cylinder 35 so the piston can exert force on the pull bolt 31 and crows foot 29. That force is displayed on dial 37A to read in tons is resisted by the bell jar 32 pushing on the plate 27. The pull bolt 31 has its outer end 31A engaged by a finger 39 of an indicator dial 40 which is mounted on a base 41. The dial pointer will move to indicate a marked difference in deformation. The object here is to employ the installation of the crows foot frame 29 and the bell jar 32 to provide early readings of the load. In the early period of the installation the load imposed by the geologic structure increases rapidly while the yield in the cable is small.

When a load is placed on the hydraulic cylinder 35 equal to the load on the roof plate 27 the deflection rate will change. The position of the change point on the deflection curve is the geologic rock load which exists on the roof plate 27.

Turning now to FIG. 7, a modified device 45 is shown in which the portion 46 directed above the circumferential fixed flange 47 is shortened so that a separate conic extension 48 can be seated on the portion 46. Various sizes of conic extensions may be provided to perform the function of extending 46 to carry the roof plate 49 which can progressively deform so it can move down on the conic surface 50 as the earth material 10 exerts its force or load on the roof plate. The force required to have the roof plate move is of course, representative of the pull or strain on the cable 12 which is secured in the device 45 by the use of tapered wedges. The wedges are placed in the tool extension 51 of the device 45 below the flange 47.

The foregoing specification and accompanying drawings have set forth a best mode disclosure of the invention, with features of the construction of a means for understanding the reaction that takes place in the geologic structure when a passage is formed therein, thereby making it necessary to install a sufficient number of cable supports to carry the loads that develop.

What is claimed is:

1. A fixture for holding tension means supporting load bearing means in a passage formed in a geologic earth structure, the fixture comprising:

a) a body having an outer elongated tapering portion projecting in one direction from a circumferential flange encircling said body and an outer tool portion projecting from said flange opposite to said outer tapering portion, said body tapering portion and said tool portion being integral with said flange, and said body further having an internally directed cylindrical bore having an end opening outwardly from said tapering portion and an internal tapering bore forming an extension of said cylindrical bore and opening through said outer tool portion, said internally directed cylindrical bore and said internal tapering bore being sized to receive a load carrying member;

b) geologic earth support means in the form of a plate cooperating with said body tapering portion to assume an initial position spaced from said flange on said body tapering portion and being movable in response to geologic earth support to provide a visually observe change in the initial spacing of said plate along said outer tapering portion relative to said flange; and c) wedge means received in said internal tapering bore of said body, said wedge means engaging the tension means for retaining said body and plate means in geologic earth supporting cooperating positions.

2. The fixture set forth in claim 1 wherein said plate means rests on said circumferential flange of said body to carry the earth structure, and said wedge means engages the tension means to retain said body and plate means in cooperation with said circumferential flange.

3. The fixture set forth in claim 1 wherein said plate means is positioned to rest upon said body adjacent said outwardly open end, and load measuring means is engaged with said body circumferential flange and said plate means for determining a load in said fixture.

4. An attachment assembly positioned at a borehole opening in a mine roof for yieldably supporting mine roof loads imposed on supporting tension means, said assembly comprising:

a) a body having an outer axially elongated cone shaped surface portion extending from an open end in one direction from a circumferential flange and a further extension in an opposite direction from said circumferential flange, and said body being formed internally with a cylindrical bore leading from said open end into said body and an internal tapering bore forming a continuation of said cylindrical bore with said tapering bore opening outwardly from said further extension;

b) roof plate means cooperating with said axially elongated cone shaped portion with an aperture therein of a size to receive the supporting tension means and assume a position adjacent said open end of said cone shaped portion on the cone shaped surface of said body to place said roof plate means against the mine roof as said body is installed, said plate means being forced by geologic load thereon to gradually move down the tapered surface providing more and more resistance to movement until it seats upon said circumferential flange to become essentially rigid; and c) wedge shaped elements receivable in said tapering bore in said body for gripping said supporting tension means to retain said body thereon with said roof plate positioned to carry loads at the mine roof opening.

5. The attachment assembly set forth in claim 4 wherein said cone shaped portion of said body has a slope of about 7° from the vertical.

6. The attachment assembly set forth in claim 4 wherein said further extension on said body is shaped to provide wrench engaging surfaces for rotating said body and tension means.

7. The attachment assembly set forth in claim 4 wherein said axially elongated cone shaped portion of said body is adapted to loosely fit in the borehole to position said roofplate against the mine roof.

8. An attachment assembly in combination with a tension member in a mine passage formed with roof bore hole, in which the attachment assembly comprises:

a) a body having a fixed flange with a first extension directed toward the roof bore hole, and an oppositely directed extension in the mine passage, said body extensions being integral with said flange and have internal passage means opening through said integral extensions to receive the tension member therein;

b) means positionable in said internal passage means to secure said body to the tension member;

c) roof plate means seated on top of said first extension to press against the mine roof under a tension load generated by the tension member secured in said body; and d) means operably engaged on said roof plate and said fixed flange of said assembly for determining the amount of a load on the roof plate.

9. The attachment assembly set forth in claim 8 wherein said first extension is formed separately from said body.

10. The attachment assembly set forth in claim 8 wherein said means for determining the amount of a load on the tension member is visually displaced.

* * * * *